US008311814B2

(12) United States Patent
Ong et al.

(10) Patent No.: US 8,311,814 B2
(45) Date of Patent: Nov. 13, 2012

(54) EFFICIENT VOICE ACTIVITY DETECTOR TO DETECT FIXED POWER SIGNALS

(75) Inventors: Mei-Sing Ong, Forestville (AU); Luke A. Tucker, Beacon Hill (AU)

(73) Assignee: Avaya Inc., Basking Ridge, NJ (US)

( * ) Notice: Subject to any disclaimer, the term of this patent is extended or adjusted under 35 U.S.C. 154(b) by 1210 days.

(21) Appl. No.: 11/523,933

(22) Filed: Sep. 19, 2006

(65) Prior Publication Data

US 2008/0071531 A1 Mar. 20, 2008

(51) Int. Cl.
*G10L 11/06* (2006.01)

(52) U.S. Cl. ..... 704/215; 704/214; 704/246; 704/247; 704/251; 704/252

(58) Field of Classification Search ..... None
See application file for complete search history.

(56) References Cited

U.S. PATENT DOCUMENTS

| | | | | |
|---|---|---|---|---|
| 5,867,574 | A | 2/1999 | Eryilmaz | |
| 6,023,674 | A | 2/2000 | Mekuria | |
| 2003/0138061 | A1 * | 7/2003 | Li | 375/326 |
| 2004/0156397 | A1 * | 8/2004 | Heikkinen et al. | 370/516 |
| 2005/0031097 | A1 * | 2/2005 | Rabenko et al. | 379/93.31 |
| 2006/0069551 | A1 | 3/2006 | Chen et al. | |
| 2006/0271354 | A1 * | 11/2006 | Sun et al. | 704/205 |
| 2007/0177620 | A1 * | 8/2007 | Ohmuro et al. | 370/412 |

FOREIGN PATENT DOCUMENTS

WO WO 93/09531 5/1993

OTHER PUBLICATIONS

The Notice of Preliminary Rejection (including translation) for Korean Patent Application No. 2007-0095514, dated Oct. 26, 2009.
Extended European Search Report and Opinion for European Patent Application No. 07115811.7, dated Sep. 24, 2009.
Spirit DSP Embedded Voice Experience; "VAD/AGC/CNG"; Internet printout from http://www.spiritdsp.com/vad_agc.html; printed Aug. 24, 2006; 3 pages.
Sodoyer; "An analysis of visual speech information applied to voice activity detection"; Internet printout from http://64.233.187.104/search?q=cache:rGA3ITzLqoJ:www.lis.inpg.fr/pages_perso/rivet/bilingue/references/RIVicassp06.pdf+ . . . ; printed Aug. 24, 2006; 8 pages.
Pham et al.; "Time-Frequency Analysis for Voice Activity Detection"; From Proceeding (520) Signal Processing, Pattern Recognition, and Applications—2006; Internet printout from http://www.actapress.com/PaperInfo.aspx?PaperID=23491; printed Aug. 24, 2006; 2 pages.
Voice Activity Detection—Wikipedia, the free encyclopedia; "Voice activity detection"; Internet printout from http://en.wikipedia.org/wiki/Voice_activity_detection; printed Aug. 24, 2006; 1 page.
Liu et al.; "A New Voice Activity Detection algorithm Based on SOM & LVQ"; International Journal of Information Technology, vol. 12, No. 6, 2006; 14 pages.

(Continued)

*Primary Examiner* — Leonard Saint Cyr
(74) *Attorney, Agent, or Firm* — Sheridan Ross P.C.

(57) ABSTRACT

The present invention is directed to a voice activity detector that uses the periodicity of amplitude peaks and valleys to identify signals of substantially fixed power or having periodicity.

18 Claims, 5 Drawing Sheets

OTHER PUBLICATIONS

Gorriz et al.; "Voice Activity Detection Using Higher Order Statistics"; html version of the file http://cvsp.cs.ntua.gr/projects/pub/HIWIRE/HiwirePublications/LNCS05.pdf; printed Aug. 24, 2006; 12 pages.
Ramirez et al.; "Improved Voice Activity Detection Combining Noise Reduction and Subband Divergence Measures"; html version of the file http://sirio/ugr.es/segura/pdfdocs/ICSLP2004a.pdf; printed Aug. 24, 2006; 8 pages.
"Voice Activity Detection in the Tiger Platform"; html version of the file http://www.diva_portal.org/diva/getDocument?urn_nbn_se_liu_diva-6586-1_fulltext.pdf; printed Aug. 24, 2006; 140 pages.
"Voice Activity Detection"; from Answers.com; Internet printout from http://www.answers.com/topic/voice-activity-detection; printed Aug. 24, 2006; 3 pages.
"Silence suppression"; from Answers.com; Internet printout from http://www.answers.com/topic/silence-suppression; printed Aug. 24, 2006; 5 pages.
Stein; "Tech View: Golden Rules for Voice over Packet"; Arrowfest 2006; Internet printout from http://www.commsdesign.com/main/9812/9812topten.htm; printed Aug. 24, 2006; 7 pages.
"Pattern matching" from Wikipedia, the free encyclopedia; Internet printout from http://en.wikipedia.org/wiki/Pattern_matching; printed Aug. 24, 2006; 9 pages.
"The Pattern Matching Algorithm"; Internet printout from http://www.datalab.uci.edu/people/xge/chart/html/node11.html; printed Aug. 24, 2006; 3 pages.
Tucker, R.; "Voice activity detection using a periodicity measure"; *Communications, Speech and Vision, IEEE Proceedings I*; Aug. 1992; vol. 139, Issue: 4; Abstract Only.
Official Action for European Patent Application No. 07115811.7, dated Jun. 4, 2010.
Official Action for China Patent Application No. 200710141317.7, dated Jan. 26, 2011.
Official Action including English translation for China Patent Application No. 200710141317.7, dated Jun. 21, 2011 9 pages.
Official Action for European Patent Application No. 07115811.7, dated Aug. 23, 2011 4 pages.
Official Action with English translation for Japan Patent Application No. 2007-241698, mailed Sep. 20, 2011 5 pages.

* cited by examiner 500 504 508 512 516

| Sample Identifier | Trend | Turning Point | Tempral Distance to Prior Turning Pint | Amplitude of Turning Point |
|---|---|---|---|---|
| 1 | Positive | N | N/A | N/A |
| 2 | Positive | N | N/A | N/A |
| 3 | Negative | Y | 0 | +11,000 |
| 4 | Negative | N | N/A | N/A |
| 5 | Negative | N | N/A | N/A |
| 6 | Negative | N | N/A | N/A |
| 7 | Negative | N | N/A | N/A |
| 8 | Positive | Y | 5 | -10,500 |
| 9 | Positive | N | N/A | N/A |
| 10 | Positive | N | N/A | N/A |
| 11 | Positive | N | N/A | N/A |
| 12 | Positive | N | N/A | N/A |
| 13 | Negative | Y | 5 | +10,700 |
| 14 | Negative | N | N/A | N/A |
| 15 | Negative | N | N/A | N/A |
| 16 | Negative | N | N/A | N/A |
| 17 | Negative | N | N/A | N/A |
| 18 | Positive | Y | 5 | -11,500 |
| 19 | Positive | N | N/A | N/A |
| 20 | Positive | N | N/A | N/A |
| ⋮ | ⋮ | ⋮ | ⋮ | ⋮ |

*Fig. 5*

EFFICIENT VOICE ACTIVITY DETECTOR TO DETECT FIXED POWER SIGNALS

FIELD OF THE INVENTION

The invention relates generally to signal processing and particularly to distinguishing speech signals from nonspeech signals.

BACKGROUND OF THE INVENTION

Voice is carried over a digital telephone network, whether circuit- or packet-switched, by converting the analog signal to a digital signal. In the case of a packet-switched network, audio samples representing the digital signal are packetized, and the packetized samples sent electronically over the network. The packetized samples are received at the destination node, the samples de-packetized, and the analog signal recreated and provided to the other party.

While talking to another party, there are periods of time when neither party is talking. During such periods, background noise (which may include background voices) may be received by the telephone's microphone. Audio information, such as background noise, that is received during periods when no party to the call is speaking and when there is no audible call signaling, such as a tone, is referred to herein as "silence".

Silence suppression is a process of not transmitting audio information over the network when one of the parties involved in a telephone call is not speaking, thereby reducing substantially bandwidth usage and assisting the identification of jitter buffer adjustment points. In a Voice over Internet Protocol ("VoIP") system, Voice Activity Detection ("VAD") or Speech Activity Detection ("SAD") is used to dynamically monitor background noise, set appropriate speech detection thresholds and identify jitter buffer adjustment points. VAD detects, in audio signals or samples thereof, the presence or absence of human speech and, using this information, identifies silence periods. When silence suppression is in effect, the audio information received during such silence periods is not transmitted over the network to the other (destination) endpoint(s). Given that typically one party in a conversation speaks at any one time, silence suppression can achieve overall bandwidth savings in the order of 50% over the duration of a typical telephone call.

Distinguishing between voiced speech and background noise can be difficult. Moreover, VAD or SAD must occur very quickly to avoid clipping. To address these issues, a number of algorithms of differing degrees of complexity have been used. Examples include those based on energy thresholds (e.g., using the Signal-to-Noise Ratio or SNR), pitch detection, spectrum or spectral shape analysis, zero-crossing rate (e.g., determining how frequently the signal amplitude changes from positive to negative), periodicity measure, higher order statistics in the Linear Predictive Code or LPC residual domain (e.g., the energy of the predictive coding error or the residual increases when there is a mismatch between the shapes of the background and input signal), and combinations thereof.

In one common silence suppression scheme, the power of the signal is used as a consistent judgment to classify a signal into voice and silence segments. It is assumed that the power of the total signal in the presence of speech is sufficiently larger than that of background noise. A threshold value is used to mark the minimum SNR for a segment to be classified as voice-active. This threshold is known as the noise floor and is dynamically recalculated using the power of the signal. If the SNR of the signal falls within the threshold, it is considered to be voice-active. Otherwise, it is regarded as background noise. This behavior can be seen from FIG. 2 in which the amplitude waveform 200 of received audio signal, power waveform 204 of the received audio signal and noise floor power waveform 208 are depicted. The value of the noise floor is a smoothed representation of the signal waveform 200. The figure further shows the detected voice active and silence segments 212 and 216, respectively. As can be seen from FIG. 2, the noise floor waveform 208 trends upward when the signal includes speech segments 220 and 224 because of the large increase in signal power and downward immediately after the segments because of the large decrease in signal power. At the heart of this algorithm is its ability to adapt to changing background noise through its implementation of a time-varying noise floor.

The above VAD schemes can have difficulty detecting signals of substantially constant power, such as progress tones (e.g., intercept tones, ringback tones, busy tones, dial tones, reorder tones, and the like). Such schemes often identify such tones as background noise, which are not transmitted to the other endpoint. The problems with detecting a progress tone are shown by FIGS. 3A and 3B. FIG. 3A shows the progress tone as a sinusoidal waveform 300. FIG. 3B shows the tone expressed as a waveform 304 having a substantially constant power level. Because the noise floor is based on the power of the signal, when the signal has a substantially constant power the noise floor waveform 308 will approach the waveform 304. Using the VAD scheme noted above, the interval 312 would be properly diagnosed as being voice-active and therefore to be transmitted to the other endpoint while the interval 316 would be misdiagnosed as silence and therefore not to be transmitted to the other endpoint. At best, the other party would thus hear only part of the tone, which could cause him or her to believe that the telephone had malfunctioned. The misdiagnosis could further cause misadjustment of the jitter buffer (which could cause clicks and pops to be heard by the other person).

Fixed power signals can be reliably detected by more elaborate approaches, such as by analyzing the frequency spectrum of the signals using complex techniques like Fast Fourier Transform (FFT) and Cepstral Analysis. However, the required processing and memory cost of transforming the signal to the frequency domain is too high and processing time too long for such algorithms to be practical in a real-time application. Some of the techniques, such as FFT, introduce delay due to the need to build buffers (blocking) of input samples and/or use larger amounts of Random Access Memory (RAM) to store. A feasible solution must necessarily be time-based.

Threshold VADs are the most commonly used solution. Under the Energy Threshold method, the energy of the total signal in the presence of speech (which includes progress tones) is assumed to be larger than a preset threshold. A signal having an amplitude more than the threshold is deemed to be voice active regardless of the VAD conclusion. This approach, though preserving much progress tone information, makes assumptions that do not hold in some applications, resulting in poor accuracy rates. Statistical analysis of the signals has also been used, such as using Amplitude Probability Distribution as a means to ascertain noise level. But again, these methods are computationally expensive and not suitable for a VoIP gateway setting.

One algorithm that has been partially successful has been used in Avaya Inc.'s Crossfire™ gateway. The gateway uses the zero crossings rate method and exploits the time-based periodicity of a fixed power signal. Noise signals are assumed to be random by nature. The zero crossing rates for each frame are monitored. A constant zero crossing rate implies periodicity and thus a voice active segment. In other words, the periodicity of the various zero crossing points is determined and pattern matching techniques used to identify zero crossing behavior characteristic of a fixed power signal.

A similar zero-crossing algorithm is used in the G.729B extension for the G.729 speech coder standardized by ITU-T. Under the extension, selections are made every 10 milliseconds on speech frames consisting of 80 audio samples. Parameters extracted from the speech frames include full band energy, low band energy, Line Spectral Frequency ("LSF") coefficients, and zero crossing rate. Differences between the four parameters extracted from the current frame and running averages of the noise are calculated for every frame. The differences represent noise characteristics. Large differences imply that the current frame is voice while the opposite implies that there is no voice present. The decision made by the VAD is based on a complex multi-boundary algorithm.

The problem with these methods is that a constant zero crossing rate does not always correspond to a periodic signal. A noise signal may cross a fixed line at a constant rate by chance. Since each segment constitutes only 80 audio samples, the accuracy of this method is limited by the small sample space. Errors in identifying zero crossing points can still cause a constant power signal to be misdiagnosed as background noise. To address this problem, such schemes may be enhanced by the use of an additional fixed threshold to ensure that high amplitude signals are always determined to be an active signal. However, the use of such a threshold can cause low amplitude, fixed-power signals to now falsely be detected as silence.

Yet another VAD scheme is proposed by Tucker R. in his paper "Voice Activity Detection Using a Periodicity Measure" published August 1992. He describes a VAD that can operate reliably in SNRs down to 0 db and detect most speech at −5 db. The detector applies a least-squares periodicity estimator to the input signal and triggers when a significant amount of periodicity is found. However, it does not aim to find the exact talkspurt boundaries and, consequently, is most suited to speech logging applications, where it is easy to include a small margin to allow for any missed speech. As will be appreciated, a "talkspurt" boundary refers to the boundary between speech and nonspeech audio information (e.g., the boundary between a period of "silence" and a period of voiced speech). The solution is unsuitable for a VoIP system, where detection of exact talkspurt boundaries is vital.

SUMMARY OF THE INVENTION

These and other needs are addressed by the various embodiments and configurations of the present invention. The present invention is directed generally to the use of amplitude-based periodicity to detect turning points (e.g., peaks and troughs) and pattern matching of the identified turning points to determine whether the sampled audio signal segment is a periodic signal or a signal of a substantially fixed power level (hereinafter "substantially fixed power signal"). Examples of substantially fixed power signals include progress tones In a first embodiment of the present invention, a method is provided that includes the steps of:

(a) receiving a plurality of audio samples, the audio samples defining a sampled signal segment;

(b) identifying turning points in a signal amplitude waveform defined by the audio samples;

(c) determining whether the identified turning points are representative of a signal of a substantially fixed power level; and (d) when the identified turning points are representative of a signal of a substantially fixed power level, deeming the sampled signal segment to include an active signal.

In a second embodiment, a method is provided that includes the steps of:

(a) during a voice conversation, receiving an analog audio signal;

(b) converting the analog audio signal into a digital representation thereof, the digital representation including a plurality of speech frames, each speech frame including a plurality of audio samples, each audio sample including a signal amplitude and having a fixed temporal duration;

(c) identifying signal amplitude turning points in the audio samples;

(d) determining whether the identified turning points are representative of aperiodic signal; and (e) when the identified turning points are representative of aperiodic signal, transmitting the selected speech frame to a destination endpoint.

The present invention need not rely on the noise floor waveform but can use a suite of other techniques, both time- and amplitude-based, to identify fixed-power signals. The use of both amplitude- and time-based periodicity can provide a much more accurate definition of the signal waveform than relying on time-based periodicity alone or a combination of time-based periodicity and zero crossings. It can thus accurately and efficiently detect the presence of fixed-power signals.

The invention can improve on schemes that rely solely on time-based periodicity. Such methods have an accuracy is in the range of 1 in 80 samples. By relying on amplitude-based periodicity, the accuracy can be improved to 1 in 65,536 amplitude levels. Periodic amplitude is a 16-bit range (i.e., +32767 to −32,768).

The invention can require much less processing resources than other solutions for performing speech suppression, thereby permitting a high channel count in a gateway using the invention. For instance, when the estimated history buffer is sized at 100 peak/trough values, it represents a RAM usage of 200 bytes, as each sample consists of 16 bits. Typically, a pattern would have less than 40 turning points. Because of the relatively low processing overhead, speech activity detection can occur quickly, avoiding clipping.

The invention can reliably identify talkspurt boundaries.

These and other advantages will be apparent from the disclosure of the invention(s) contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The above-described embodiments and configurations are neither complete nor exhaustive. As will be appreciated, other embodiments of the invention are possible utilizing, alone or in combination, one or more of the features set forth above or described in detail below.

BRIEF DESCRIPTION OF THE DRAWINGS

FIG. 5 is a set of data structures according to an embodiment of the present invention.

DETAILED DESCRIPTION

Figure 1:
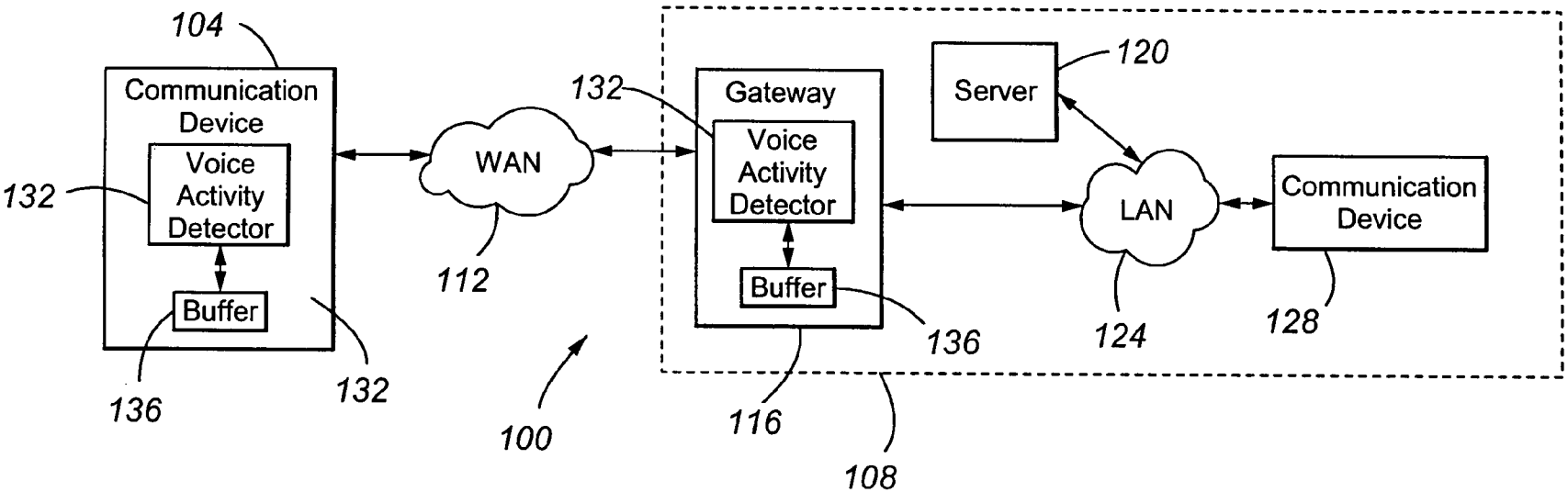
FIG. 1 depicts a voice communications architecture according to a first embodiment of the present invention.
Figure 2:
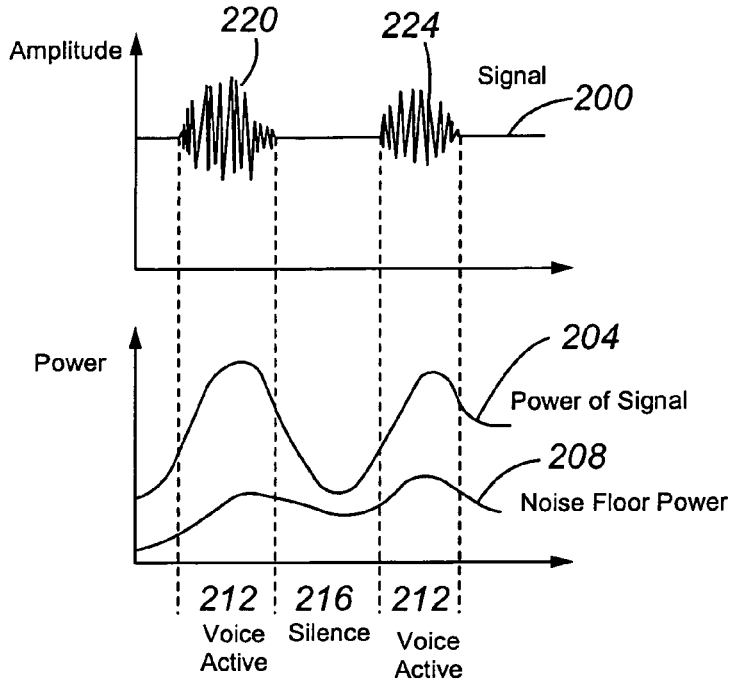
Fig. 2 Prior Art
FIG. 2 depicts the response of a noise floor power waveform to speech variations in the power of a received signal.
Figure 3A:
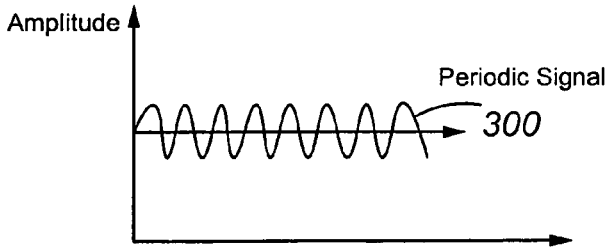
Fig. 3A Prior Art
FIGS. 3A and 3B depict a periodic signal waveform and the response of a noise floor power waveform to the substantially constant power of the signal.
Figure 3B:
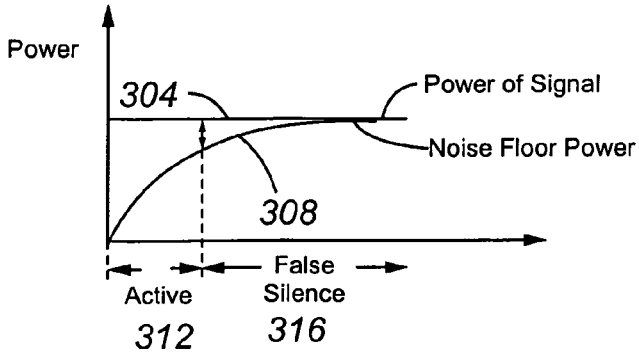
Fig. 3B Prior Art

An architecture 100 according to a first embodiment is depicted in FIG. 1. The architecture 100 includes a voice communication device 104 and enterprise network 108 interconnected by a Wide Area Network or WAN 112. The enterprise network 108 includes a gateway 116 servicing a server 120, Local Area Network 124, and communication device 128.

The gateway 116 can be any suitable device for controlling ingress to and egress from the corresponding LAN. The gateway is positioned logically between the other components in the corresponding enterprise premises 108 and the network 112 to process communications passing between the server 120 and internal communication device 128 on the one hand and the network 112 on the other. The gateway 116 typically includes an electronic repeater functionality that intercepts and steers electrical signals from the network 112 to the corresponding LAN 124 and vice versa and provides code and protocol conversion. When processing voice communications, the gateway 116 further performs a number of VoIP functions, particularly silence suppression and jitter buffer processing. The gateway 116 therefore includes a Voice Activity Detector 132 to perform VAD and SAD and a comfort noise generator (not shown) to generate comfort noise during periods of silence. Comfort noise is synthetic background noise, which prevents the listener from perceiving, from the periods of absolute silence resulting from silence suppression, that the communication channel has been disconnected. Examples of suitable gateways include modified versions of Avaya Inc. 's, G700, G650, G350, Crossfire, MCC/SCC media gateways and Acme Packet's Net-Net 4000 Session Border Controller.

The server 120 processes call control signaling, such as incoming Voice Over IP or VoIP and telephone call set up and tear down messages. The term "server", as used herein, should be understood to include an ACD, a Private Branch Exchange PBX (or Private Automatic Exchange PAX) an enterprise switch, an enterprise server, or other type of telecommunications system switch or server, as well as other types of processor-based communication control devices such as media servers, computers, adjuncts, etc. Illustratively, the server of FIG. 1 can be Avaya Inc.'s Definity™ Private-Branch Exchange (PBX)-based ACD system or MultiVantage PBX running modified Advocate™ software, CRM Central 2000 Server™, Communication Manager, S8300™ media server, SIP Enabled Services™, and/or Avaya Interaction Center™.

The internal and external communication devices 104 and 128 are preferably packet-switched stations or communication devices, such as IP hardphones (e.g., Avaya Inc.'s 4600 Series IP Phones™), IP softphones (e.g., Avaya Inc.'s IP Softphone™), Personal Digital Assistants or PDAs, Personal Computers or PCs, laptops, packet-based H.320 video phones and conferencing units, packet-based voice messaging and response units, peer-to-peer based communication devices, and packet-based traditional computer telephony adjuncts. Examples of suitable devices are the 4610™, 4621SW™, and 9620™ IP telephones of Avaya, Inc.

The voice activity detector 116, as can be seen from FIG. 1, can be located in a number of components depending on the architecture.

The detector 132 exploits the periodicity of a fixed signal by detecting peaks and troughs (i.e. turning points). In addition to time-based periodicity, the detector 132 uses amplitude-based periodicity. It relies on the detection of regular patterns within the signal. The detector 132 can be efficient, as it does not require significant signal processing resources to detect a fixed power signal.

A buffer 136 of n audio samples is stored. The number of samples is typically the same number of audio samples contained in a packet (or frame) to be transmitted to the destination communication device. N is frequently 80, as this represents 10 milliseconds of voice sampled at 8 kHz. The detector 132 iterates over this buffer 136, one-sample-at-a-time, and records selected characteristics of the sampled portion of the signal. In particular, the high and low points of the signal (e.g., peaks and troughs) are recorded. This information, when combined with the previous history of the recorded signal features, provides a condensed historical span of what the pattern is like.

Followed by this, there is a post processing step to search the gathered information for a pattern (or template). This is typically done by searching for repetitions. For example with a dual frequency signal, the detector 132 searches for a signal pattern having two distinct peaks and two distinct troughs and, for a single frequency signal, for a signal pattern having only one peak and only one trough. When the values do not fit the selected pattern, the sampled signal is deemed to be a more random signal and is rejected by the algorithm. Account can be taken of the noise floor waveform and any possible interference by establishing a range within which two values are considered to be similar. This allows the algorithm to execute in the presence of background noise.

An example of the recorded data structures generated during processing of the samples in the buffer 136 is shown in FIG. 5. As can be seen from FIG. 5, each audio sample has a corresponding sample identifier 500, which for simplicity sake is shown as being consecutively numbered. Each sample is analyzed for whether it is, relative to the prior sample, trending upward (positive) or downward (negative) in amplitude. When the trend 504 changes between adjacent samples, a turning point, or a peak or valley, is identified. With reference to FIG. 5, turning points are identified in one of or between samples 2 and 3 (a peak), 7 and 8 (a valley), 12 and 13 (a peak), and 17 and 18 (a valley). Each instance of a turning point is marked by a suitable indicator 508 (e.g., "Y" meaning that a turning point exists and "N" meaning that a turning point does not exist). The temporal distance to the prior turning point 512 is tracked by counting the number of samples to the prior instance of a turning point because the sample size is associated with a fixed time period (e.g, 10 milliseconds). For example, the temporal distance associated with the turning point at sample 3 is 0 (because there is no sample data prior to sample 1), at sample 8 is 5 (or 50 milliseconds), at sample 13 is 5 (or 50 milliseconds), and at sample 18 is 5 (or 50 milliseconds). Finally, the amplitude 516 of each turning point is recorded. For example, the amplitude of the turning point at sample 3 is +11,000 units, at sample 8 is −10,500 units, at sample 13 is +10,700 units, and at sample 18 is −11,500 units. As will be appreciated, periodic amplitude is a 16-bit range (i.e., +32767 to −32,768). As will be further appreciated, to save memory space the data structures may be abbreviated to include only those samples associated with a turning point (e.g., to include only samples 3, 8, 13, and 18).

The resulting recorded data is then examined for the occurrence of a fixed pattern within the signal itself based on the periodicity of turning points and amplitude of those points. The fixed pattern within the signal may be identified by comparing the data to one or more templates typical of different types of progress tones, such as intercept tones, ringback tones, busy tones, dial tones, reorder tones, and the like, to determine whether the analyzed sampled signal segment is a fixed signal. As noted, the pattern searched for in a dual frequency signal has first and second sets of distinct peaks and first and second sets of distinct troughs arranged in alternating fashion. The pattern searched for in a single frequency signal set of peaks and a set of troughs arranged in alternating fashion. Most progress tones are single frequency signals. The pattern is defined using not only the temporal periodicity of the turning points but also the signal amplitude at the turning points. A probability may be used to determine how well the segment fits the pattern. Probabilities below a specified threshold are not deemed to be fixed signals while probabilities at or above the specified threshold are deemed to be fixed signals. As can be seen from the data structures in FIG. 5, the sampled signal segment would be deemed to be a fixed signal.

As will be appreciated, any suitable pattern matching algorithm may be used to post process. Such algorithms generally check for the presence of the constituents of a given pattern.

An example of a relatively simple algorithm is to construct first and second arrays describing a sampled audio signal segment. The first array comprises the number of instances of selected temporal distances between turning points. For example, the array would contain a number of instances for each of the selected temporal distances of 1, 2, 3, 4, . . . . The second array comprises the number of instances of a number of selected amplitude ranges at turning points. For example, the array would contain a number of instances for each of the amplitude ranges A-B, B-C, C-D, . . . , where A, B, C, D, . . . are amplitude values. The resulting instances in each array column could then be compared to specified templates for temporal and amplitude periodicity to determine if the signal segment is likely a fixed signal segment. The templates may be, for example, a maximum permissible distribution of the instances among differing array columns. If the instances are too widely distributed, the comparison would indicate that the signal segment is variable while a tighter distribution indicates that the signal segment is fixed. The template match probabilities from the comparisons to the first and second arrays can then be weighted to arrive at a combined probability that the signal segment is characteristic of a fixed or variable signal.

Figure 4A:
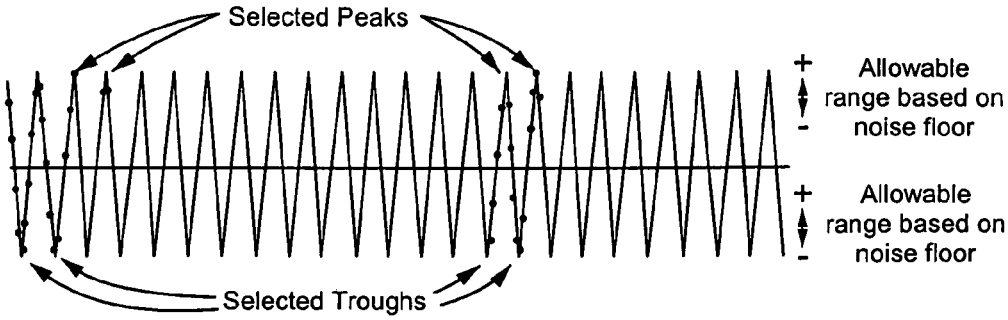
FIGS. 4A and 4B depict periodic signal waveforms to illustrate concepts of the present invention.
Figure 4B:
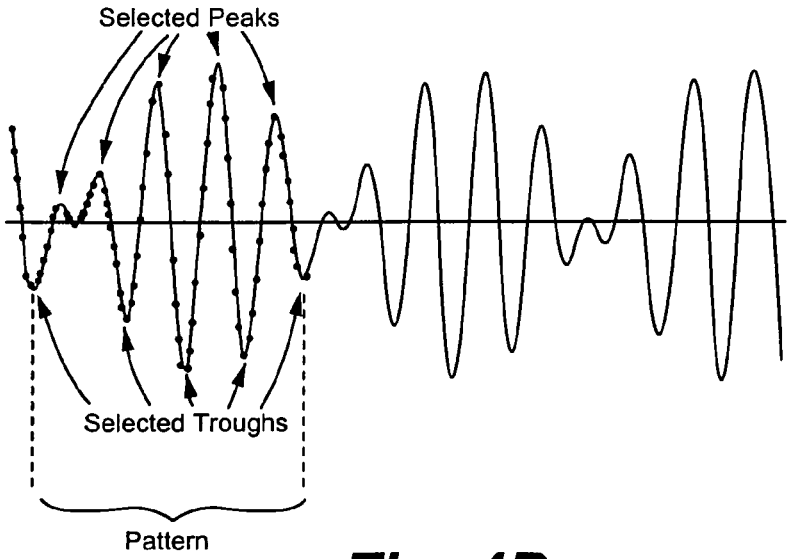

This analytical approach is further shown in FIGS. 4A and B. FIGS. 4A and 4B show fixed or constant signals, such as a tone, and, for comparison sake, the allowable range based on the noise floor waveform. Various sample points are further shown in each signal segment. The dashed lines in FIG. 4B show the periodic signal pattern. As can be seen from FIGS. 4A and 4B, the sample points would display behavior similar to that of FIG. 5. As can be seen by the dashed lines, the pattern of the signal of FIG. 4B is repeated in the next signal segment, though the amplitudes of the turning points might have shifted slightly. The algorithm of the present invention can be written in a way that is capable of detecting patterns in the presence of minor waveform imperfections. In other words, the pattern does not have to match exactly. This can be particularly important as signals can become distorted by background noise. The imperfections are taken into account, at least in part, because substantial similarity or dissimilarity in signal amplitude between the template and the analyzed sampled signal segment is normally weighted more heavily than substantial similarity or dissimilarity in temporal spacing between turning points.

Figure 6:
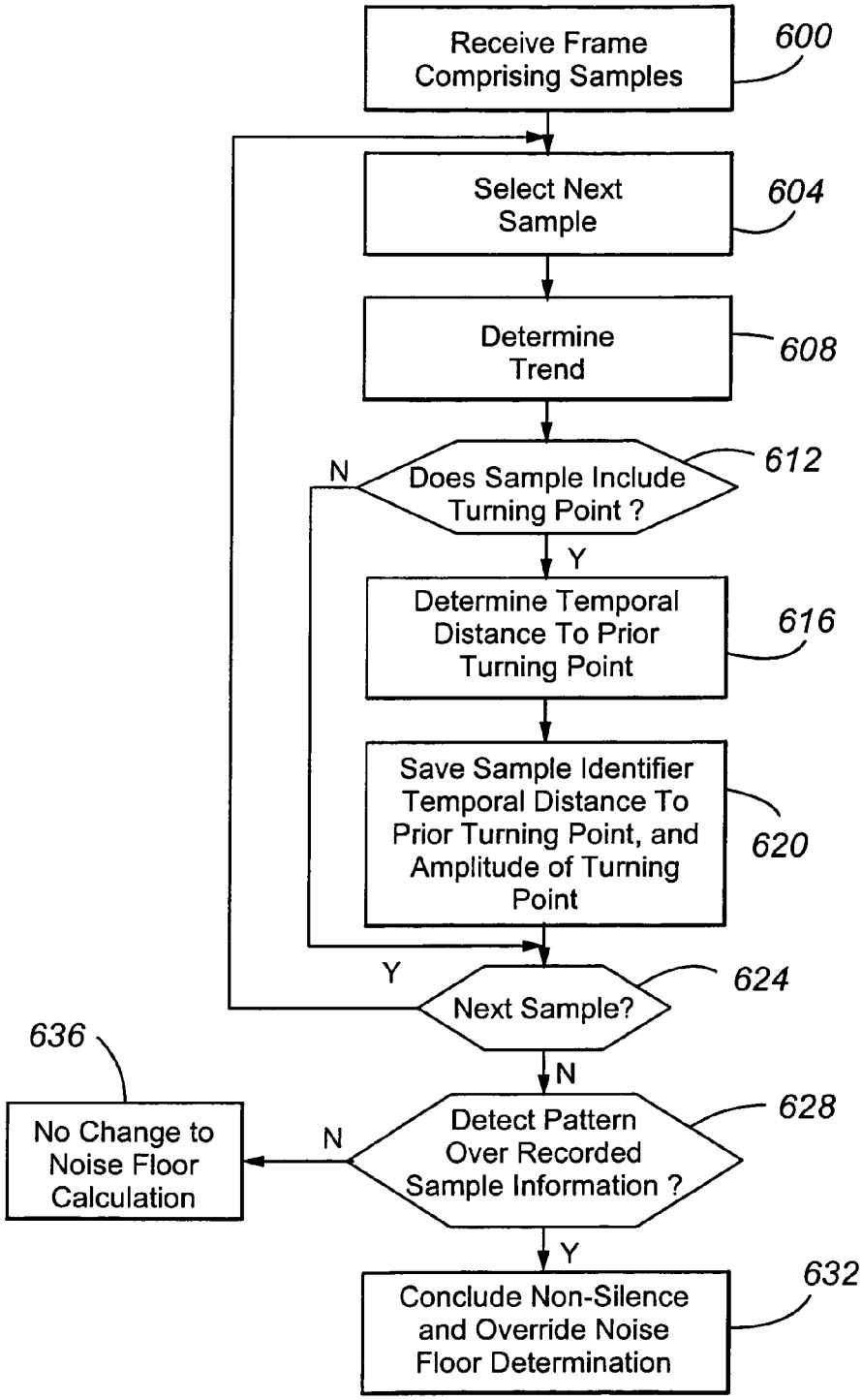
FIG. 6 is a flow chart according to an embodiment of the present invention.

The operation of the detector 132 will now be described with reference to FIG. 6.

In step 600, a frame comprising n audio signal samples is received. The samples in the frame are generated when the received analog audio signal is converted to digital form. The following steps are performed sample-by-sample and frame-by-frame. As noted, a packet will commonly contain one frame of 80 samples.

In step 604, a next sample is selected for analysis.

In step 608, the trend indicated by the selected sample is determined. As noted, the trend is typically determined by comparing the amplitude of the selected sample with the amplitude of the prior sample. If the amplitude is increasing, the trend is positive, and, if the amplitude is decreasing, the trend is negative.

In decision diamond 612, it is determined whether the sample includes a turning point. When a trend changes from positive in the prior sample to negative in the selected sample or from negative in the prior sample to positive in the selected sample, the selected sample is deemed to include a turning point.

When the selected sample includes a turning point, the temporal distance to the prior turning point is determined in step 616. This is done by counting the number of samples between the selected sample and the most recent (prior) sample containing a turning point.

In step 620, the sample identifier, a turning point indicator, a temporal distance from the turning point in the selected sample to the prior turning point, and an amplitude of the current turning point are saved.

When the selected sample does not include a turning point or after step 616, it is determined, in decision diamond 624, whether there is a next sample. If so, the detector returns to step 604. If not, the detector, in decision diamond 628, determines whether the recorded data defines a pattern. When the recorded data likely defines a pattern, the detector, in step 632, concludes that the audio samples in the selected packet are not silence and overrides any contrary determination made by another technique, such as by using the noise floor waveform. When the recorded data likely does not define a pattern, the detector, in step 636, concludes that the audio samples in the selected packet are not a fixed signal. Therefore, no change is made to the result determined by another technique.

Depending on the contents of the frame, it is either discarded as silence or packetized and transmitted to the destination endpoint as an active signal.

A number of variations and modifications of the invention can be used. It would be possible to provide for some features of the invention without providing others.

For example in one alternative embodiment, the present invention is used for non-VoIP applications, such as speech coding and automatic speech recognition.

In yet another embodiment, dedicated hardware implementations including, but not limited to, Application Specific Integrated Circuits or ASICs, programmable logic arrays, and other hardware devices can likewise be constructed to implement the methods described herein. Furthermore, alternative software implementations including, but not limited to, distributed processing or component/object distributed processing, parallel processing, or virtual machine processing can also be constructed to implement the methods described herein.

It should also be stated that the software implementations of the present invention are optionally stored on a tangible storage medium, such as a magnetic medium like a disk or tape, a magneto-optical or optical medium like a disk, or a solid state medium like a memory card or other package that houses one or more read-only (non-volatile) memories. A digital file attachment to e-mail or other self-contained information archive or set of archives is considered a distribution medium equivalent to a tangible storage medium. Accordingly, the invention is considered to include a tangible storage medium or distribution medium and prior art-recognized equivalents and successor media, in which the software implementations of the present invention are stored.

Although the present invention describes components and functions implemented in the embodiments with reference to particular standards and protocols, the invention is not limited to such standards and protocols. Other similar standards and protocols not mentioned herein are in existence and are considered to be included in the present invention. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present invention.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

a processor receiving a plurality of audio samples, the audio samples defining a sampled signal segment;

the processor creating a signal amplitude waveform defined by the audio samples;

the processor determining a trend in the signal amplitude waveform by comparing a first amplitude of an audio sample with a second amplitude of a previous audio sample;

the processor identifying turning points in the signal amplitude waveform, wherein the turning points occur when the trend changes from positive to negative or from negative to positive;

the processor determining an amplitude for each of the turning points;

the processor determining whether the amplitudes of the identified turning points are representative of a signal of a substantially fixed power level; and when the amplitudes of the identified turning points are representative of a signal of a substantially fixed power level, the processor deeming the sampled signal segment to comprise an active signal, wherein the turning points are not zero crossings, and wherein, when the identified turning points are representative of a signal of a substantially fixed power level, the sampled signal segment is deemed to include a progress tone.

2. The method of claim 1, wherein the sampled signal segment is received as part of a live voice call between first and second parties, wherein the turning points correspond to peaks and valleys in the signal amplitude waveform, and wherein, when the identified turning points are representative of a signal of a substantially fixed power level, the sampled signal segment is deemed to include a periodic pattern.

3. The method of claim 2, wherein silence suppression is in effect and wherein, when the sampled signal segment comprises an active signal, transmitting the plurality of audio samples to a destination node and wherein, when the sampled signal segment does not comprise an active signal and when the segment does not comprise voice energy of the first and/or second parties, not transmitting the plurality of audio samples to the destination node.

4. The method of claim 1, wherein the method is used for determining jitter buffer adjustment points and further comprising:

identifying temporal distances between adjacent, identified turning points in the signal amplitude waveform;

determining whether the temporal distances between adjacent, identified turning points are representative of a signal of a substantially fixed power level; and when the temporal distances are representative of a signal of a substantially fixed power level and when the identified turning points are representative of a signal of a substantially fixed power level, deeming the sampled signal segment to comprise an active signal.

5. The method of claim 4, wherein, in determining whether the sampled signal segment comprises an active signal, the results of determining whether an amplitude of the identified turning points are representative of a signal of a substantially fixed power level are weighted more heavily than the results of determining whether the temporal distances between adjacent, identified turning points are representative of a signal of a substantially fixed power level.

6. A non-transitory computer readable medium comprising processor executable instructions to perform the steps of claim 1.

7. The method of claim 1, wherein the identified turning points in the signal amplitude wave form are compared to turning points in a template of a progress tone.

8. A non-transitory computer readable medium comprising processor executable instructions to perform method comprising:

during a voice conversation, a processor receiving an analog audio signal;

the processor converting the analog audio signal into a digital representation thereof, the digital representation comprising a plurality of speech frames, each speech frame comprising a plurality of audio samples, each audio sample comprising a signal amplitude and having a fixed temporal duration;

the processor creating a signal amplitude waveform defined by the audio samples;

the processor determining a trend in the signal amplitude waveform by comparing a first signal amplitude of a first audio sample with a second signal amplitude of a previous second audio sample;

the processor identifying signal amplitude turning points in the audio samples, wherein the turning points occur when the trend changes from positive to negative or from negative to positive;

the processor determining an amplitude of the identified signal amplitude turning points in the audio samples;

the processor determining whether the identified turning points are representative of a periodic signal; and when the identified turning points are representative of a periodic signal and have an amplitude representative of a fixed power signal, the processor transmitting the selected speech frame to a destination endpoint, wherein the turning points are not zero crossings and wherein, when the identified turning points are representative of a signal of a substantially fixed power level, the sampled signal segment is deemed to include a progress tone.

9. The computer readable medium of claim 8, wherein, when the identified turning points are representative of a periodic signal, not allowing the jitter buffer to adjust and wherein, when the identified turning points are not representative of a periodic signal, wherein, when the selected frame does not comprise voiced speech, not transmitting the selected speech frame to the destination endpoint and the jitter buffer is not allowed to adjust.

10. The computer readable medium of claim 8, wherein the periodic signal has a substantially fixed power level and further comprising:

identifying temporal distances between adjacent, identified turning points; and determining whether the temporal distances between adjacent, identified turning points are representative of a periodic signal; and wherein, in determining whether the identified turning points are representative of a periodic signal, when the temporal distances are representative of a periodic signal and, when the identified turning points are representative of a periodic signal, the selected frame is deemed to include a progress tone.

11. The computer readable medium of claim 8, wherein the identified turning points in the signal amplitude wave form are compared to turning points in a template of a progress tone.

12. A device, comprising:

a memory;

a processor in communication with the memory, the processor operable to execute a voice activity detector, the voice activity detector operable to:

receive a plurality of audio samples, the audio samples defining a sampled signal segment;

create a signal amplitude waveform from the audio samples, wherein the signal amplitude waveform is a digital signal;

identify turning points in the signal amplitude waveform defined by the audio samples;

identify temporal distances between adjacent, identified turning points in the signal amplitude waveform;

based on the temporal distances between adjacent, identified turning points in the signal amplitude waveform, determine whether the identified turning points are representative of a periodic signal;

if the identified turning points are representative of a periodic signal, determine whether an amplitudes of the identified turning points are representative of a signal of a substantially fixed power level; and when the amplitudes of the identified turning points are representative of a signal of a substantially fixed power level, deem the sampled signal segment to comprise an active signal, wherein the turning points are not zero crossings and wherein, when the identified turning points are representative of a signal of a substantially fixed power level, the sampled signal segment is deemed to include a progress tone.

13. The device of claim 12, wherein the sampled signal segment is received as part of a live voice call between first and second parties, wherein the turning points correspond to peaks and valleys in the signal amplitude waveform, and wherein, when the identified turning points are representative of a signal of a substantially fixed power level, the jitter buffer is not allowed to adjust.

14. The device of claim 13, wherein silence suppression is in effect and wherein, when the sampled signal segment comprises an active signal, transmitting the plurality of audio samples to a destination node but not allowing the jitter buffer to adjust and wherein, when the sampled signal segment does not comprise an active signal and when the segment does not comprise voice energy of the first and/or second parties, not transmitting the plurality of audio samples to the destination node but allowing the jitter buffer to adjust.

15. The device of claim 12, wherein, in determining whether the sampled signal segment comprises an active signal, the results of determining whether the identified turning points are representative of a signal of a substantially fixed power level are weighted more heavily than the results of determining whether the temporal distances between adjacent, identified turning points are representative of a signal of a substantially fixed power level.

16. The device of claim 12, wherein the device is a gateway.

17. The device of claim 12, wherein the device is a packet-switched voice communication device.

18. The device of claim 12, wherein the identified turning points in the signal amplitude wave form are compared to turning points in a template of a progress tone.

* * * * *

UNITED STATES PATENT AND TRADEMARK OFFICE

CERTIFICATE OF CORRECTION

PATENT NO. : 8,311,814 B2
APPLICATION NO. : 11/523933
DATED : November 13, 2012
INVENTOR(S) : Mei-Sing Ong et al.

It is certified that error appears in the above-identified patent and that said Letters Patent is hereby corrected as shown below:

In the Claims:

Column 12, line 20, please delete “an”.

Signed and Sealed this
Fourteenth Day of May, 2013

Teresa Stanek Rea
*Acting Director of the United States Patent and Trademark Office*